US007102586B2

(12) United States Patent
Liang et al.

(10) Patent No.: US 7,102,586 B2
(45) Date of Patent: Sep. 5, 2006

(54) ANTENNA AND ANTENNA ARRAY

(75) Inventors: Jia-Haur Liang, Gaosyung (TW); Ting-Yi Tsai, Taipei (TW)

(73) Assignee: Accton Technology Corporation, Hsinchu (TW)

( * ) Notice: Subject to any disclaimer, the term of this patent is extended or adjusted under 35 U.S.C. 154(b) by 0 days.

(21) Appl. No.: 10/978,567

(22) Filed: Nov. 2, 2004

(65) Prior Publication Data

US 2005/0280579 A1 Dec. 22, 2005

(30) Foreign Application Priority Data

Jun. 21, 2004 (TW) ..... 93117862 A

(51) Int. Cl.
*H01Q 9/28* (2006.01)

(52) U.S. Cl. ..... 343/795; 343/745

(58) Field of Classification Search ..... 343/745, 343/749–752, 795

See application file for complete search history.

(56) References Cited

U.S. PATENT DOCUMENTS 3,339,205 A * 8/1967 Smitka ..... 343/701
6,195,065 B1 * 2/2001 Hung et al. ..... 343/876
6,417,807 B1 * 7/2002 Hsu et al. ..... 343/700 MS
6,529,170 B1 * 3/2003 Nishizawa et al. ..... 343/795
6,552,689 B1 * 4/2003 Shinichi ..... 343/702
6,734,828 B1 * 5/2004 Shor ..... 343/795

* cited by examiner

*Primary Examiner*—Tan Ho
(74) *Attorney, Agent, or Firm*—Troxell Law Office, PLLC

(57) ABSTRACT

The present invention discloses an antenna comprising a substrate, a first dual-frequency antenna, a second dual-frequency antenna, a first frequency select switch, a second frequency select switch and a feed end, wherein the first and the second dual-frequency antennas are disposed on the substrate, and the first frequency select switch has a first end connected to the first dual-frequency antenna and a second end connected to a first radiating conductive wire, and the second frequency select switch has a first end connected to the second dual-frequency antennas and a second end connected to a second radiating conductive wire, and the feed end is disposed between the first dual-frequency antenna and the second dual-frequency antenna. The present invention also discloses an antenna array comprising a substrate, two dual-frequency antenna pairs and a feed structure; wherein the two dual-frequency antenna pairs are installed on the substrate correspondently and the feed part is connected between the two dual-frequency antenna pairs.

26 Claims, 7 Drawing Sheets

FUG. 4

ANTENNA AND ANTENNA ARRAY

FIELD OF THE INVENTION

The present invention relates to an antenna and an antenna array, and more particularly, to an antenna and antenna array that can be operated at two different frequency bands.

BACKGROUND OF THE INVENTION

As the wireless communications industry blooms, the fast development of wireless transmissions brings in various products and technologies that are used in multiple-frequency transmissions. Thus, many products are equipped with the wireless transmission capability to meet consumer requirements. In addition, it is very important for a wireless transmission product to have a good antenna.

In general, conventional antennas for wireless transmission products are divided into two types: Planar Inverted F Antenna (PIFA) and dual-frequency dipole antenna, and both types have an operating mode that resonates at ¼ wavelength. Further, these conventional antennas can only provide a single frequency band for its operation. As the market grows and the technology advances, a single frequency band no longer can meet the market requirement. Therefore, the present invention provides an antenna that can be operated in a dual-frequency mode.

SUMMARY OF THE INVENTION

The primary objective of the invention is to provide an antenna and an antenna array that both can be operated at two different frequency bands for sending and receiving signals of two different frequencies.

To achieve the foregoing objectives, the invention provides an antenna comprising: a substrate, a first dual-frequency antenna, a second dual-frequency antenna, a first frequency select switch, a second frequency select switch and a feed end; wherein the first and the second dual-frequency antennas are disposed on the substrate, and the first frequency select switch has a first end connected to the first dual-frequency antenna and a second end connected to a first radiating conductive wire, and the second frequency select switch has a first end connected to the second dual-frequency antennas and a second end connected to a second radiating conductive wire, and the feed end is disposed between the first dual-frequency antenna and the second dual-frequency antenna.

The present invention also provides an antenna array comprising: a substrate, two dual-frequency antenna pairs and a feed part; wherein the two dual-frequency antenna pairs are built on the substrate, each pair comprising: a first and a second dual-frequency antennas; wherein, the second dual-frequency antenna and the first dual-frequency antenna are symmetrically disposed by which a first frequency select switch is coupled to the first dual-frequency antenna connecting to a first radiating conductive wire and a second frequency select switch is coupled to the second dual-frequency antenna connecting to a second radiating conductive wire; and a feed part is connected between the two dual-frequency antenna pairs.

To make it easier for our examiner to understand the objective of the invention, its structure, innovative features, and performance, we use a preferred embodiment including but not limited to the attached drawings for the detailed description of the invention.

DESCRIPTION OF THE PREFERRED EMBODIMENT

Figure 1A:
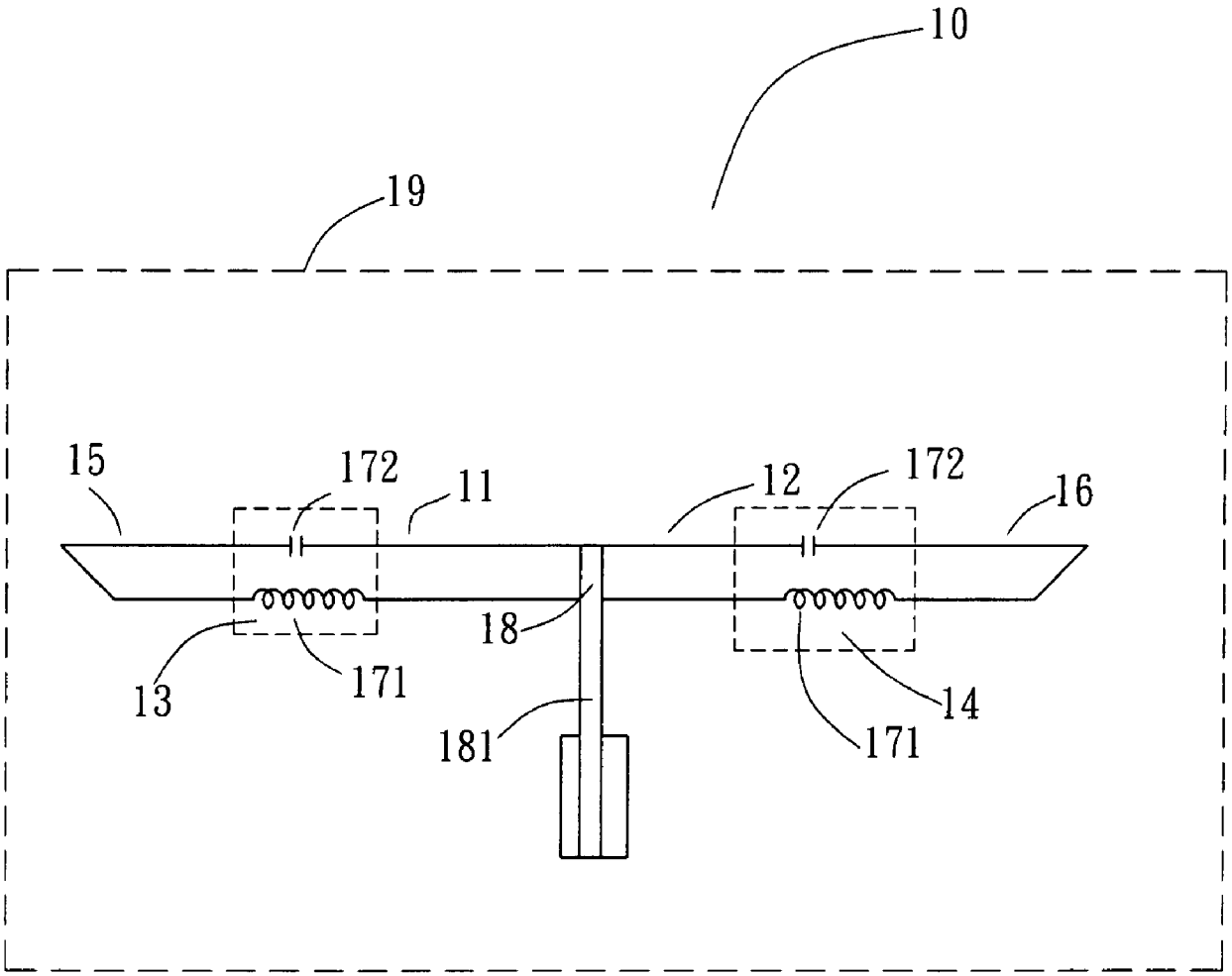
FIGS. 1A and 1B are illustrative views of the antenna according to a first preferred embodiment of the present invention.
Figure 1B:
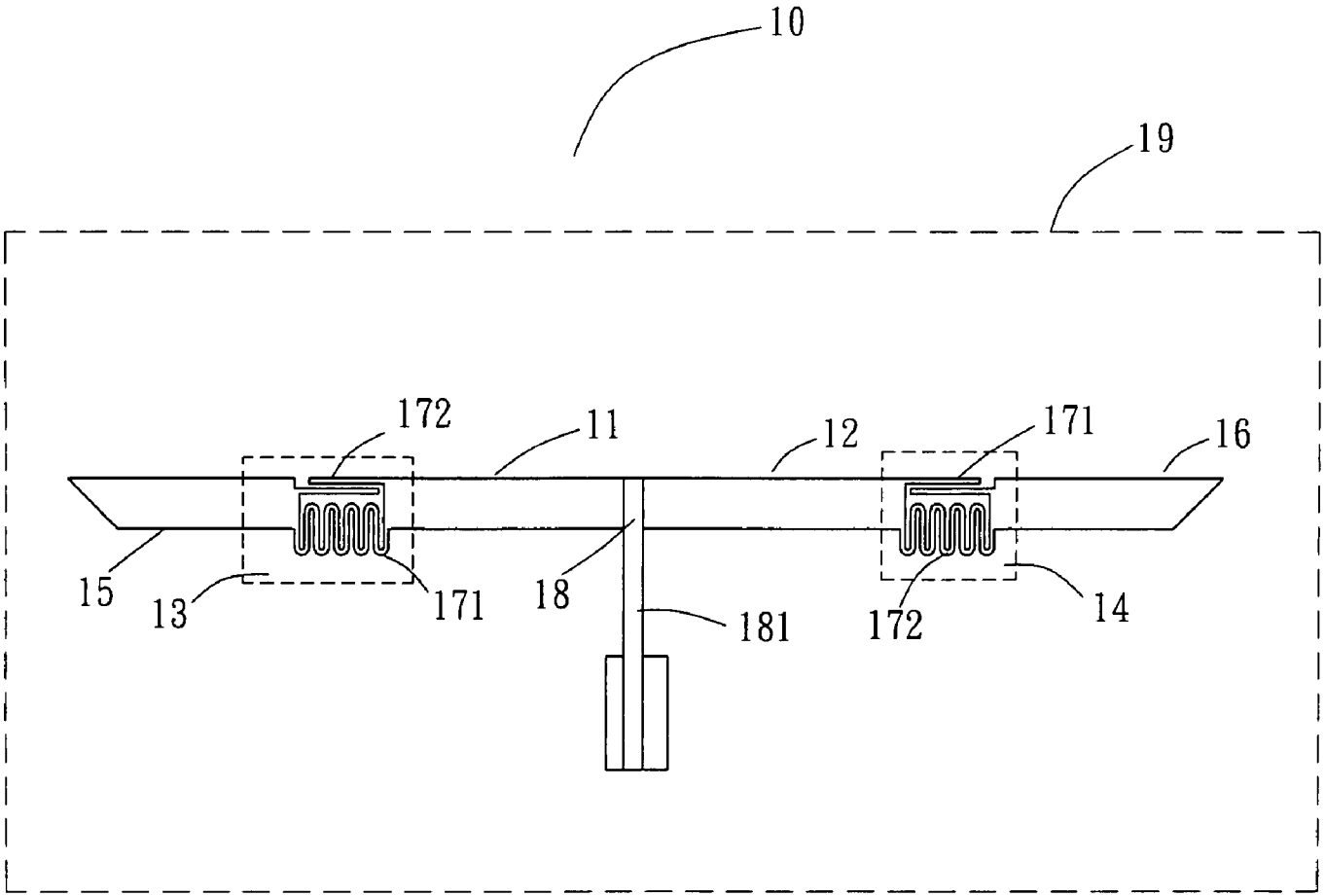

Please refer to FIGS. 1A and 1B for the illustrative views of the antenna according to a preferred embodiment of the present invention. The antenna 10 is substantially a dipole antenna, comprising a substrate 19, a first dual-frequency antenna 11, a second dual-frequency antenna 12, a first frequency select switch 13, a second frequency select switch 14 and a feed end 18. The substrate 19 is substantially either a printed circuit board made of fiberglass reinforced epoxy resin (FR4) or bismaleimide-triazine (BT), or a flexible film substrate made of polyimide. The first dual-frequency antenna 11 and the second dual-frequency antenna 12 are metal conductive wires printed on the substrate 19, which are symmetrically disposed on the substrate 19. The first frequency select switch 13 has a first end and a second end, and the first end is connected to the first dual-frequency antenna 11 and the second end is connected to a first radiating conductive wire 15. The second frequency select switch 14 is coupled between the second dual-frequency antenna 12 and a second radiating conductive wire 16. The feed end 18 is disposed between the first dual-frequency antenna 11 and the second dual-frequency antenna 12, such that a signal can be inputted at the feed end 18 and then is transmitted out by the first and second dual-frequency antennas 11, 12. The feed end 18 can be connected to a feed connecting wire 181 for transmitting signals. Both the first frequency select switch 13 and the second frequency select switch 14 are consisted of an inductor 171 and a capacitor 172, and the inductor 171 is parallel-connected to the capacitor 172.

If the antenna 10 is working at a high frequency, the connection of the inductor 171 and the capacitor 172 with the first radiating conductive wire 15 or the second radiating conductive wire 16 form a trap circuit, and such arrangement allows the antenna 10 to work at two different frequency ranges (i.e. a first frequency signal and a second frequency signal respectively having frequency band ranges, such as 5.1~5.875 GHz and 2.1~2.7 GHz ) according to the length of the first radiating conductive wire 15 or the second radiating conductive wire 16, and the values of the inductor 171 and the capacitor 172. In this design, the first and second dual-frequency antennas 11, 12 can be elongated by the first and second radiating conductive wires 15, 16 respectively, so that the first and second dual-frequency antennas 11, 12 resonate at 2.1~2.7 GHz. When the antenna 10 of the present invention inputs a first frequency signal with a frequency of 5.1~5.875 GHz at the feed end 18, the antenna 10 only resonates at the first and second dual-frequency antennas 11, 12. When a second frequency signal with a frequency of 2.1~2.7 GHz is inputted at the feed end 18, the first and second dual-frequency antenna 10 will resonate with the first radiating conductive wire 15 and the second radiating conductive wire 16 respectively for receiving or transmitting the second frequency signal with a frequency of 2.1~2.7 GHz.

Figure 2A:
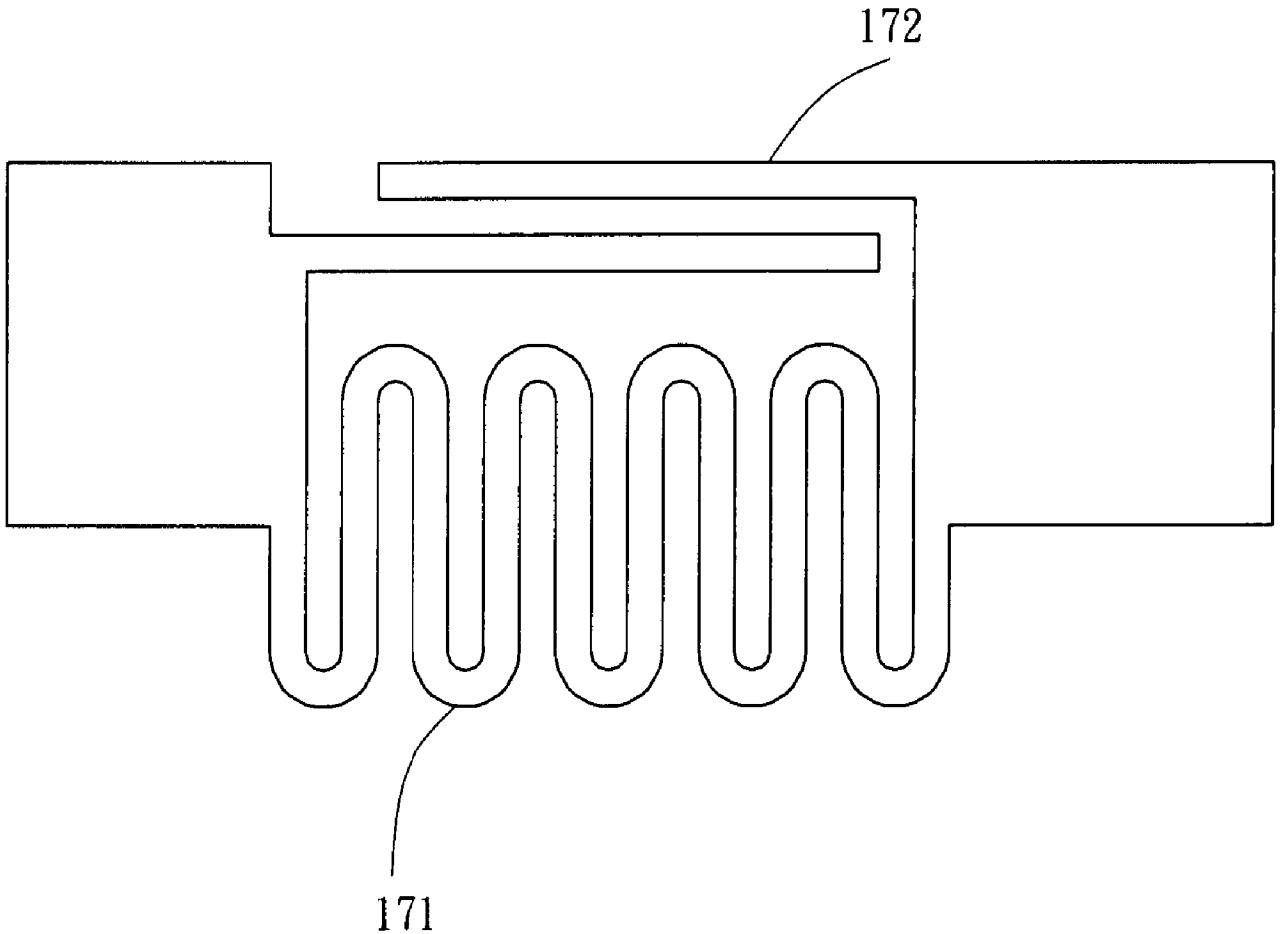
FIG. 2A is an illustrative view of the frequency select switch according to a preferred embodiment of the present invention.

In this preferred embodiment, the inductor 171 is a meander line inductor as shown in FIG. 2A which is substantially a curved microstrip line printed on the substrate 19 enabling an inductance effect when operated at a high frequency, and the capacitor 172 is substantially a parallel-coupled microstrip line capacitor printed on the substrate 19 enabling a capacitance effect when operated at a high frequency.

Figure 2B:
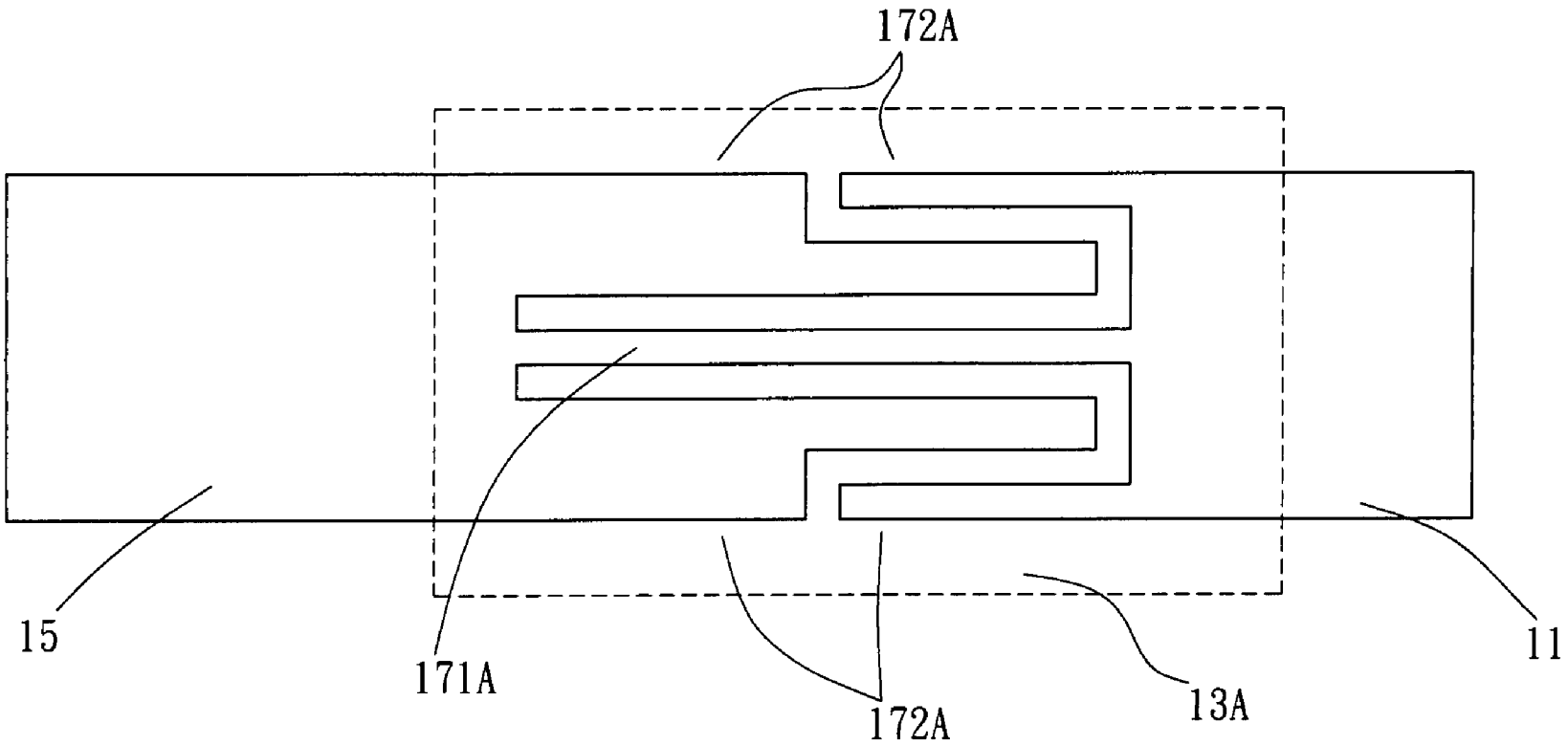
FIG. 2B is an illustrative view of the frequency select switch according to another preferred embodiment of the present invention.

Please refer to FIG. 2B for the first frequency select switch 13A according to another preferred embodiment of the present invention. The first frequency select switch 13A is consisted of an inductor 171 A and two capacitors 172A. The inductor 171A is a narrow straight-line microstrip inductor having a first end connected to the first dual-frequency antenna 11, and a second end connected to the first radiating conductive wire 15. The capacitor 172A is a parallel-coupled microstrip line capacitor in another form. The second frequency select switch 14A operates the same way as the first frequency select switch 13A, and thus will not be described hereinafter.

Figure 3:
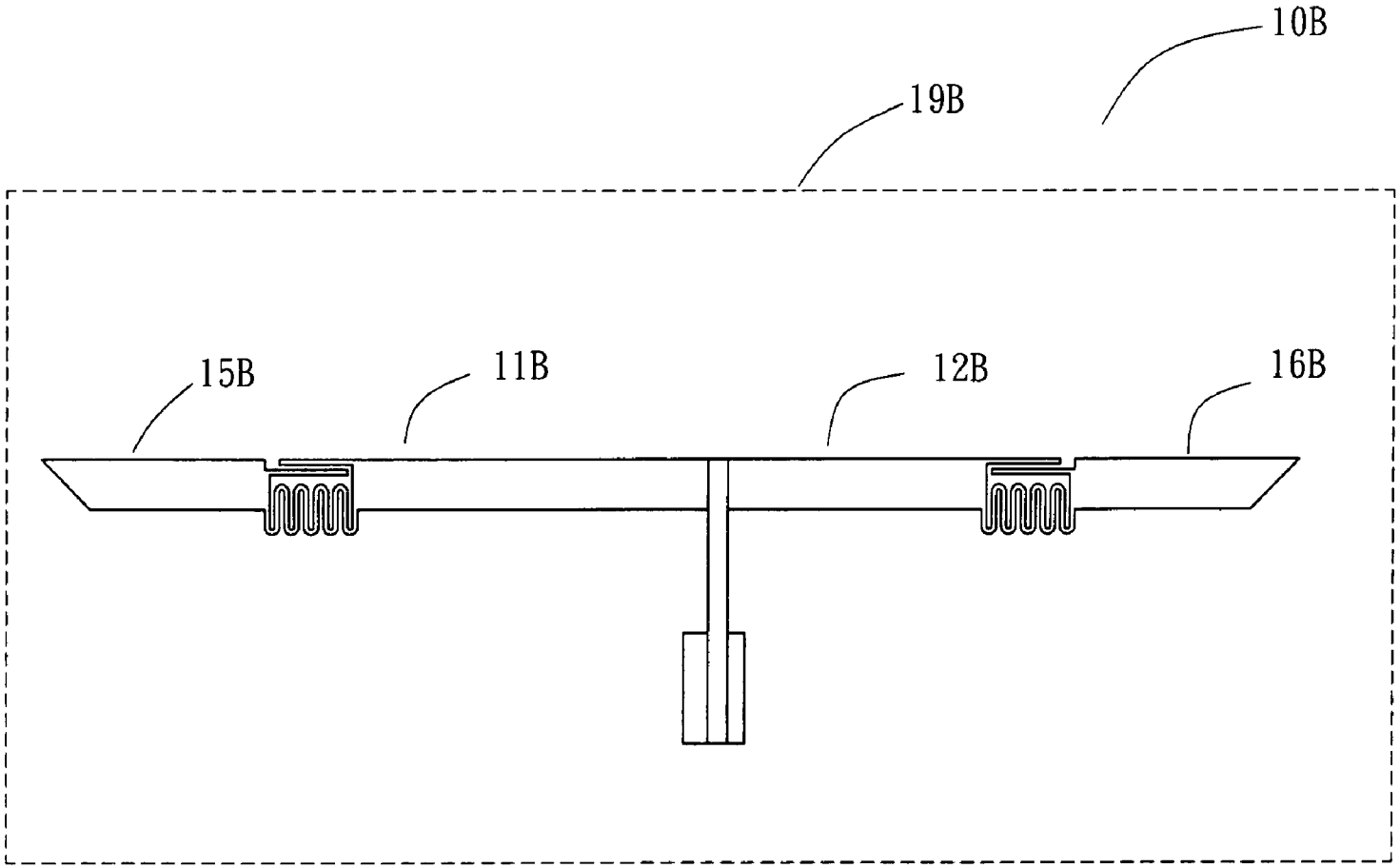
FIG. 3 is an illustrative view of the antenna according to a second preferred embodiment of the present invention.

Please refer to FIG. 3, which is an illustrative view of the antenna 10B according to a second preferred embodiment of the present invention. The first dual-frequency antenna 11B and the second dual-frequency antenna 12B could be antennas of unequal length, and the first and second radiating conductive wire 15B, 16B also could be a conductive wire of unequal length as to enable their operating frequency range to have a broader coverage.

Figure 4:
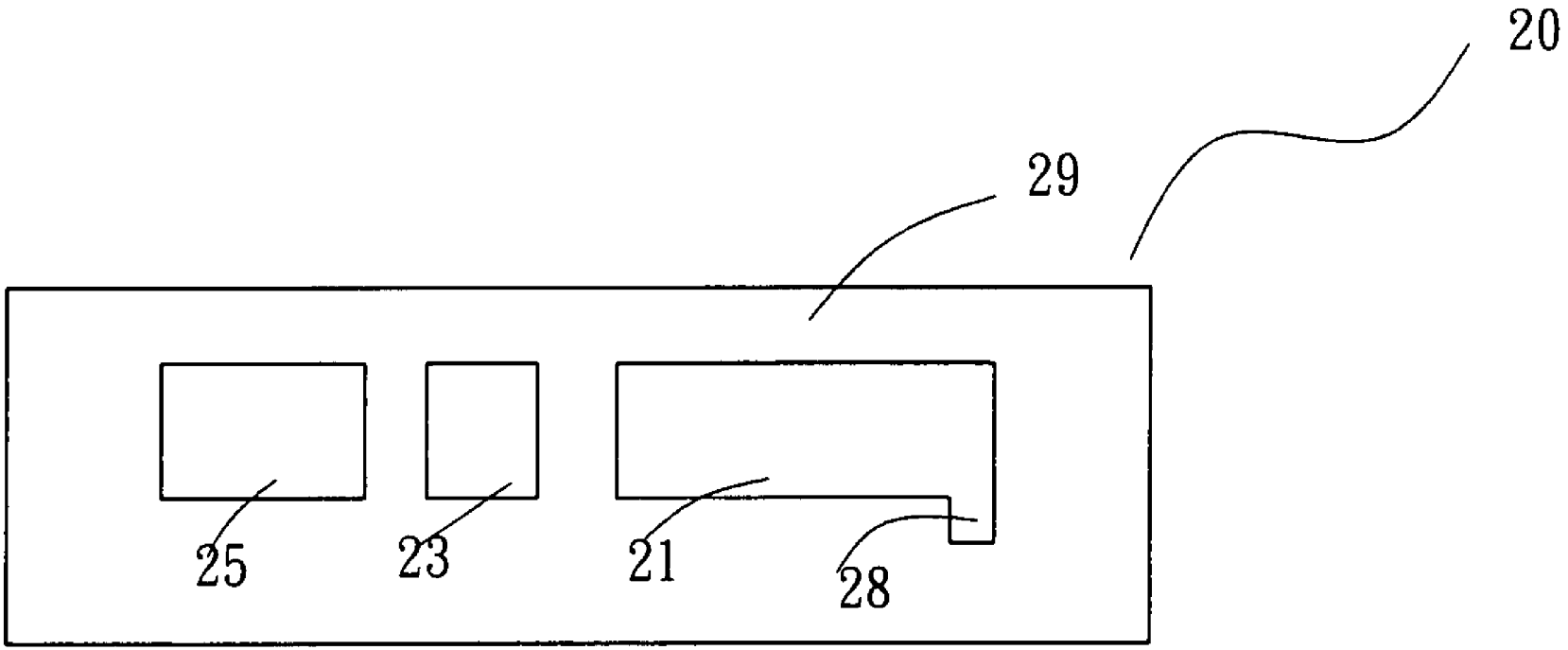
FIG. 4 is an illustrative view of the antenna according to a third preferred embodiment of the present invention.

Please refer to FIG. 4 for the antenna according to another preferred embodiment of the present invention. The antenna 20 is substantially a monopole antenna, and such antenna 20 comprises a substrate 29, a first radiating conductive wire 21, a frequency select switch 23, a second radiating conductive wire 25 and a feed end 28. The substrate 29 is substantially either a printed circuit board made of fiberglass reinforced epoxy resin (FR4) or bismaleimide-triazine (BT), or a flexible film substrate made of polyimide. The first radiating conductive wire 21 and the second radiating conductive wire 25 are metal conductive wire printed on the substrate 29, and frequency select switch 23 has a first end connected to the first radiating conductive wire 21, and a second end connected to the second radiating conductive wire 25. The first radiating conductive wire 21 has a feed end 28 such that a signal can be inputted into the feed end 28 and is then transmitted out by the first and second radiating conductive wires 21, 25. The frequency select switch 23 could be either the frequency select switches 13, 14 as shown in FIG. 2A or the frequency select switches 13A, 14A as shown in FIG. 2B, and thus will not be described hereinafter.

If the antenna 20 is working at a high frequency, the frequency select switch 23 forms a trap circuit for enabling the antenna 20 to operate at two different frequency ranges (i.e. a first frequency signal and a second frequency signal respectively with a frequency band range, such as at 5.1~5.875 GHz and 2.1~2.7 GHz) according to the length of the first radiating conductive wire 21 or that of the second radiating conductive wire 25. The antenna 20 can resonate at 2.1~2.7 GHz by using the total length of the first radiating conductive wire 21 and the second radiating conductive wire 25. That is, when the antenna 20 of the present invention inputs a first frequency signal with a frequency of 5.1~5.875 GHz from the feed end 28 while the length of the first radiating conductive wire can be a quarter wavelength of the first frequency, the antenna 20 will transmit the signal through the first radiating conductive wire 21, and when the antenna 20 of the present invention inputs a second frequency signal with a frequency of 2.1~2.7 GHz from the feed end 28 while the length of the first radiating conductive wire can be a quarter wavelength of the second frequency, the antenna 20 will transmit the signal through the first radiating conductive wire 21 and the second radiating conductive wire 25.

Figure 5:
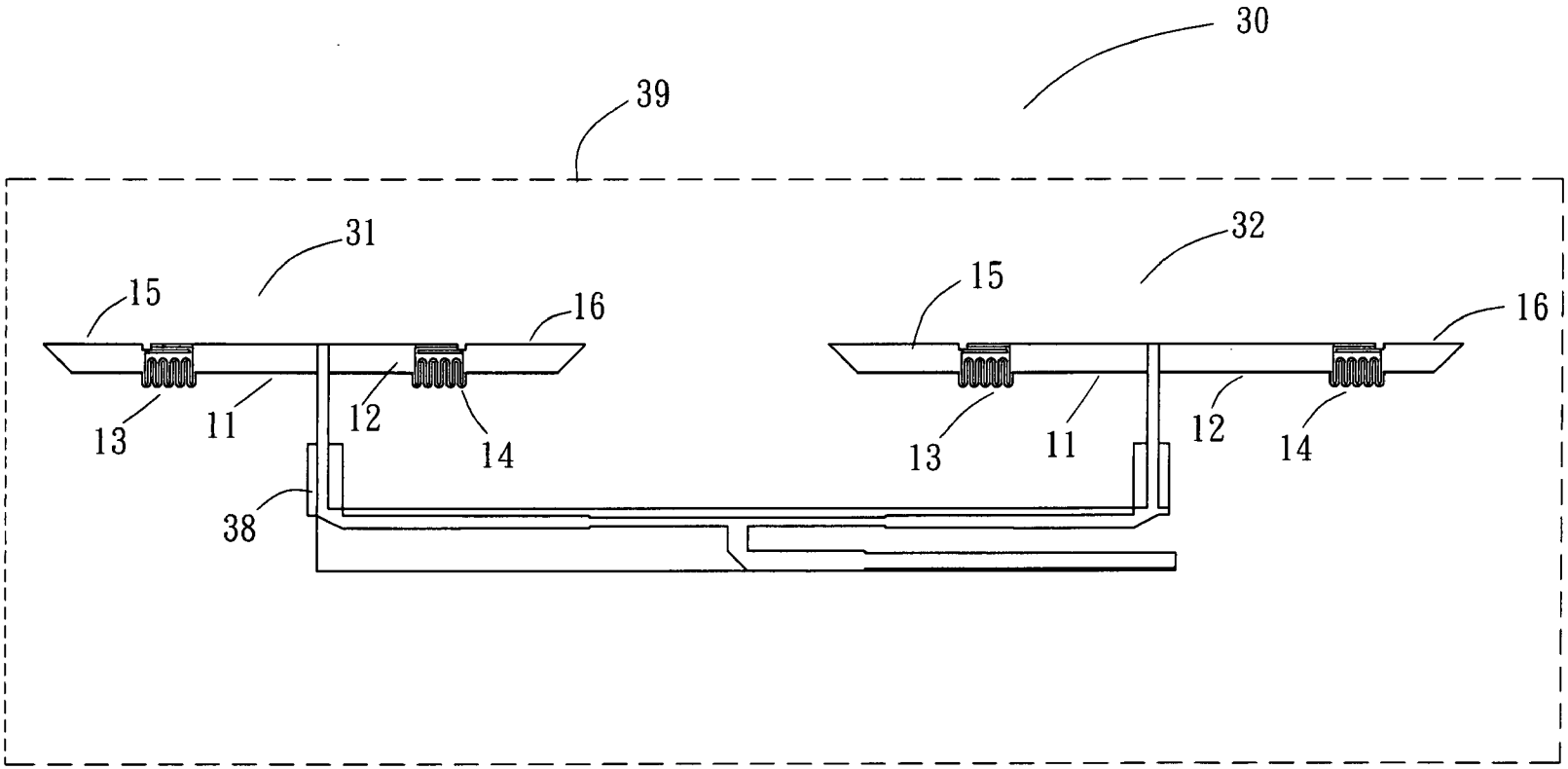
FIG. 5 is an illustrative view of the antenna array according to a preferred embodiment of the present invention.

Please refer to FIG. 5 for the antenna array 30 according to a preferred embodiment of the present invention. The antenna array 30 comprises a substrate 39, two dual-frequency antenna pairs 31, 32 and a feed part 38. The substrate 39 is substantially either a printed circuit board made of fiberglass reinforced epoxy resin (FR4) or bismaleimide-triazine (BT), or a flexible film substrate made of polyimide. Two antenna 20 can be printed on the substrate 39 to like as an antenna array. The two dual-frequency antenna pairs 31, 32 are similar to the antenna 10 as shown in FIG. 1 and each has same components, and thus of the same name. The dual-frequency antenna pair 31 comprises a first dual-frequency antenna 11, a second dual-frequency antenna 12, a first frequency select switch 13 and a second frequency select switch 14; wherein the first frequency select switch 13 is coupled to a first radiating conductive wire 15 and the second frequency select switch 14 is coupled to a second radiating conductive wire 16. Such antenna array 30 can improve the radiation efficiency and antenna gain. The feed network 38 is connected between the two dual-frequency antenna pairs 31, 32 for transmitting signals.

The foregoing antenna and antenna arrays can be used in two frequency ranges. Further, the application of the present invention is not limited to the two frequency ranges of 5.1~5.875 GHz and 2.1~2.7 GHz, but covers different frequency ranges by adjusting the length of the antenna and the values of the inductor and capacitor.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. An antenna, comprising:

substrate;

first radiating conductive wire, being disposed on said substrate;

second radiating conductive wire, being disposed on said substrate;

frequency switch device, being coupled between said first radiating conductive wire and said second radiating conductive wire, wherein said frequency switch device comprises an inductor, being printed on said substrate, wherein the inductor is a meander line inductor or is a narrow straight-line microstrip line inductor, having an end thereof coupled to said first radiating conductive wire and another end thereof coupled to said second radiating conductive wire;

at least a capacitor, being printed on said substrate, and being parallel-connected to said inductor; and a feed end, being disposed at a position near said first radiating conductive wire.

2. The antenna of claim 1, wherein said capacitor is a parallel-coupled microstrip line capacitor.

3. The antenna of claim 1, wherein said capacitor comprises: a first microstrip line connected to said first radiating conductive wire, and a second microstrip line connected to said second radiating conductive wire.

4. The antenna of claim 1, wherein said first radiating conductive wire is enabled while a signal of a first frequency is inputted to said feed end, and both said first radiating conductive wire and said second radiating conductive wire are enabled jointly while a signal of a second frequency is inputted to said feed end.

5. The antenna of claim 4, wherein the frequency range of said first frequency is between 5.1~5.875 GHz.

6. The antenna of claim 5, wherein the frequency range of said second frequency is between 2.1~2.7 GHz.

7. The antenna of claim 6, wherein said first signal and said second signal have different frequency ranges respectively based on the length of the first and the second radiating conductive wires.

8. The antenna of claim 6, wherein the length of said first radiating conductive wire is a quarter wavelength of said second frequency.

9. The antenna of claim 5, wherein the length of said first radiating conductive wire is a quarter wavelength of said first frequency.

10. The antenna of claim 1, wherein said feed end is coupled to a feed microstrip line.

11. An antenna, comprising:

a substrate;

a first dual-frequency antenna, being disposed on said substrate;

a second dual-frequency antenna, being disposed symmetrically with said first dual-frequency antenna on another side of said substrate;

a first frequency select switch, having a first end and a second end, and said first end being coupled to said first dual-frequency antenna and said second end being coupled to a first radiating conductive wire;

a second frequency select switch, having a first end and a second end, and said first end being coupled to said second dual-frequency antenna and said second end is coupled to a second radiating conductive wire;

wherein each of said first and second frequency select switches comprises an inductor that is a meander line inductor or a narrow straight-line microstrip line inductor, and a capacitor, both being disposed on said substrate; and a feed end, being disposed between said first dual-frequency antenna and said second dual-frequency antenna.

12. The antenna of claim 11, wherein said capacitor is a parallel-coupled microstrip line capacitor.

13. The antenna of claim 11, wherein said first dual-frequency antenna and the second dual-frequency antenna are enabled while a signal of a first frequency is inputted to said feed end, and said first dual-frequency antenna and the second dual-frequency antenna respectively cooperating with said first radiating conductive wire and said second radiating conductive wire are enabled while a signal of a second frequency is inputted to said feed end.

14. The antenna of claim 13, wherein the frequency range of said first frequency is between 5.1~5.875 GHz.

15. The antenna of claim 14, wherein the frequency range of said second frequency is between 2.1~2.7 GHz.

16. The antenna of claim 13, wherein said first signal and said second signal have different frequency ranges respectively based on the length of the first and the second radiating conductive wires.

17. The antenna of claim 11, wherein said first dual-frequency antenna and said dual-frequency antenna are equal in length.

18. The antenna of claim 11, wherein said first dual-frequency antenna and said dual-frequency antenna are unequal in length.

19. An antenna array, comprising:

a substrate;

at least two dual-frequency antenna pairs, being disposed on said substrate and each comprising:

a first dual-frequency antenna;

a second dual-frequency antenna, being disposed symmetrically with said first dual-frequency antenna;

a first frequency select switch, being coupled to said first dual-frequency antenna and connected to a first radiating conductive wire;

a second frequency select switch, being coupled to said second dual-frequency antenna and connected to a second radiating conductive wire;

wherein each of said first and second frequency switch devices comprises an inductor, being printed on said substrate, that is a meander line inductor or a narrow straight-line microstrip line inductor; and at least one capacitor, being printed on said substrate and parallel-connected to said inductor; and a feed part, being coupled to said two dual-frequency antenna pair.

20. The antenna of claim 19, wherein said capacitor is a parallel-coupled microstrip line capacitor.

21. The antenna of claim 19, wherein said first dual-frequency antenna and the second dual-frequency antenna are enabled while a signal of a first frequency is inputted to said feed part, and said first dual-frequency antenna and the second dual-frequency antenna respectively cooperating with said first radiating conductive wire and said second radiating conductive wire are enabled while a signal of a second frequency is inputted to said feed part.

22. The antenna of claim 21, wherein the frequency range of said first frequency is between 5.1~5.875 GHz.

23. The antenna of claim 22, wherein the frequency range of said second frequency is between 2.1~2.7 GHz.

24. The antenna of claim 21, wherein said first signal and said second signal have different frequency ranges respectively based on the length of the first and the second radiating conductive wires.

25. The antenna of claim 19, wherein said first dual-frequency antenna and said second dual-frequency antenna are equal in length.

26. The antenna of claim 19, wherein said first dual-frequency antenna and said second dual-frequency antenna are unequal in length.

* * * * *